US008142344B2

(12) United States Patent
Slattery, III et al.

(10) Patent No.: US 8,142,344 B2
(45) Date of Patent: Mar. 27, 2012

(54) FULLY IMPLANTABLE HEARING AID SYSTEM

(75) Inventors: William H. Slattery, III, Los Angeles, CA (US); Alfred E. Mann, Beverly Hills, CA (US); Byron L. Moran, Santa Barbara, CA (US)

(73) Assignee: Advanced Bionics AG, Zug (CH)

( * ) Notice: Subject to any disclaimer, the term of this patent is extended or adjusted under 35 U.S.C. 154(b) by 1245 days.

(21) Appl. No.: 11/883,728

(22) PCT Filed: Feb. 23, 2006

(86) PCT No.: PCT/US2006/006588

§ 371 (c)(1), (2), (4) Date: Aug. 2, 2007

(87) PCT Pub. No.: WO2006/091808

PCT Pub. Date: Aug. 31, 2006

(65) Prior Publication Data

US 2008/0139874 A1 Jun. 12, 2008

(51) Int. Cl.
*H04R 25/00* (2006.01)

(52) U.S. Cl. ..... 600/25

(58) Field of Classification Search ..... 600/25; 607/55–57; 128/897, 898

See application file for complete search history.

(56) References Cited

U.S. PATENT DOCUMENTS

| | | | | |
|---|---|---|---|---|
| 4,729,366 | A | 3/1988 | Schaefer | |
| 5,411,467 | A | 5/1995 | Hortmann et al. | |
| 5,430,801 | A | 7/1995 | Hill | |
| 5,772,575 | A * | 6/1998 | Lesinski et al. | 600/25 |
| 5,814,095 | A | 9/1998 | Müller et al. | |
| 5,897,486 | A | 4/1999 | Ball et al. | |
| 6,050,933 | A | 4/2000 | Bushek et al. | |
| 6,094,493 | A | 7/2000 | Borowsky et al. | |
| 6,390,971 | B1 | 5/2002 | Adams et al. | |
| 6,537,200 | B2 | 3/2003 | Leysieffer et al. | |
| 6,694,034 | B2 | 2/2004 | Julstrom et al. | |
| 6,786,860 | B2 | 9/2004 | Maltan et al. | |
| 6,879,693 | B2 | 4/2005 | Miller et al. | |
| 6,879,695 | B2 | 4/2005 | Maltan et al. | |
| 7,127,078 | B2 | 10/2006 | Mann et al. | |
| 2003/0086583 | A1 * | 5/2003 | Maltan et al. | 381/328 |

* cited by examiner

*Primary Examiner* — Samuel Gilbert

(74) *Attorney, Agent, or Firm* — Arthur Frelich; Mary Elizabeth Bush

(57) ABSTRACT

A fully implantable hearing aid system comprised of an implantable sound generator module and an implantable sound receiver module connected by an implantable electric cable. The system includes: a) a sound generator module configured for implantation in subcutaneous tissue to place an output electric/acoustic (E/A) transducer, e.g., a speaker, immediately adjacent to, or preferably, extending percutaneously into, a patient's outer ear canal; b) a sound receiver module configured for implantation proximate to a patient's pinna to place an input acoustic/electric (AJE) transducer, e.g., a microphone, so that it is acoustically isolated from the E/A transducer; and c) an electric cable configured for implantation in subcutaneous tissue for directly electrically connecting said sound receiver module and said sound generator module.

20 Claims, 3 Drawing Sheets

FULLY IMPLANTABLE HEARING AID SYSTEM

FIELD OF THE INVENTION

This invention relates generally to hearing aids and more particularly to a fully implantable hearing aid system and method of implanting.

BACKGROUND OF THE INVENTION

International Application PCT/US2003/035348 entitled "Implanted Outer Ear Canal Hearing Aid" (incorporated herein by reference) describes a system including a sound generating implant configured for implantation in the soft tissue between a patient's ear canal and his retro-auricular space. The implant preferably comprises a case having a proximal end subcutaneously implanted proximate to the patient's retro-auricular space and a distal end implanted proximate to the patient's outer ear canal. An electric/acoustic transducer, e.g., a speaker is mounted at the case distal end for producing sound energy which is projected into the patient's outer ear canal. The case distal end can terminate just under the skin surrounding the ear canal or can percutaneously protrude into the canal. The hearing aid system also includes an acoustic/electric transducer, e.g., a microphone, located remote from the implant, e.g., in an external housing carried by the patient. The microphone produces an electric signal representative of audible sound which can be coupled by wireless telemetry to drive the implant speaker.

International Application PCT/US2004/011079 entitled "Percutaneously Implantable Medical Device Configured To Promote Tissue Ingrowth" (incorporated herein by reference) describes an exemplary implant structure configured for use in a hearing aid system of the type described in the aforementioned '035348 PCT application. The exemplary implant structure includes a case, or housing, having a body portion and a forwardly projecting stud at the case distal end adapted to project percutaneously into the patients outer ear canal. A porous material is preferably provided on the outer surface of the stud to promote healthy tissue ingrowth for anchoring the implant and forming a bacteria resistant barrier.

SUMMARY OF THE INVENTION

The present invention is directed to a fully implantable hearing aid system comprised of an implantable sound generator module and an implantable sound receiver module connected by an implantable electric cable. A system in accordance with the invention avoids the necessity of using wireless telemetry to communicate received sound to the sound generator thus potentially reducing costs and power requirements and enhancing sound quality.

More particularly, a hearing aid system in accordance with the invention includes:

a) a sound generator module configured for implantation in subcutaneous tissue to place an output electric/acoustic (E/A) transducer, e.g., a speaker, immediately adjacent to, or preferably, extending percutaneously into, a patients outer ear canal;

b) a sound receiver module configured for implantation proximate to the patient's pinna to place an input acoustic/electric (A/E) transducer, e.g., a microphone, so that it is acoustically isolated from the E/A transducer; and c) an electric cable configured for implantation in subcutaneous tissue for directly electrically connecting said sound receiver module and said sound generator module.

A hearing aid system in accordance with the invention is intended for implantation in a simple procedure capable of being performed within a physicians office under local anesthesia. More particularly, a preferred procedure in accordance with the invention avoids any need for deep tissue cutting and/or bone modification.

In a preferred embodiment, the sound generator module is implanted adjacent to the patient's outer Ear canal as by passing it through a cannula lumen tunneled through soft tissue from an incision behind the patient's pinna (as described more fully in International Application PCT/US2004/041596 entitled "Surgical Instrument Set And Procedure For Implementing Sound Transducer Proximate To Patient's Outer Ear Canal", which application is incorporated herein by reference). The sound generator module is preferably provided with an electric cable extending from its proximal end. One end of the cable can be permanently connected to electronic circuitry (including said E/A transducer) within the module and the other, or free, end can be connected to the sound receiver module.

In accordance with a preferred implantation procedure, the free end of the cable, remote from the sound generator module, is surgically tunneled between the patient's skin and bone to a receiver site preferably located above the patient's pinna. The aforementioned sound receiver module, preferably a microphone, is implanted at the receiver site and connected to the cable free end. The microphone can be implanted selectively either (1) completely under the skin (subcutaneous) enabling it to gather acoustic energy through the skin or (2) partially under the skin with a diaphragm portion protruding through the skin (percutaneous) to directly gather sound energy. The diaphragm portion may be covered by a suitable membrane, e.g., silicone, to facilitate sound transmission and to protect the diaphragm.

A preferred microphone in accordance with the invention comprises a very thin case (e.g., <2 mm) enabling it to be implanted at the receiver site in a pocket between the skin and temporal bone without requiring any bone modification. The receiver site is preferably located above the patient's pinna to optimally gather ambient sound and yet be sufficiently isolated from the E/A transducer which projects sound into the patient's outer ear canal.

The cable which is surgically tunneled between skin and bone from the sound generator module proximal end to the receiver site can be electrically connected to the microphone as part of the implantation procedure. Alternatively, the microphone can be permanently electrically connected to the cable if its dimensions are selected to be sufficiently small to allow it to be tunneled subcutaneously to the receiver site.

DETAILED DESCRIPTION

Figure 1:
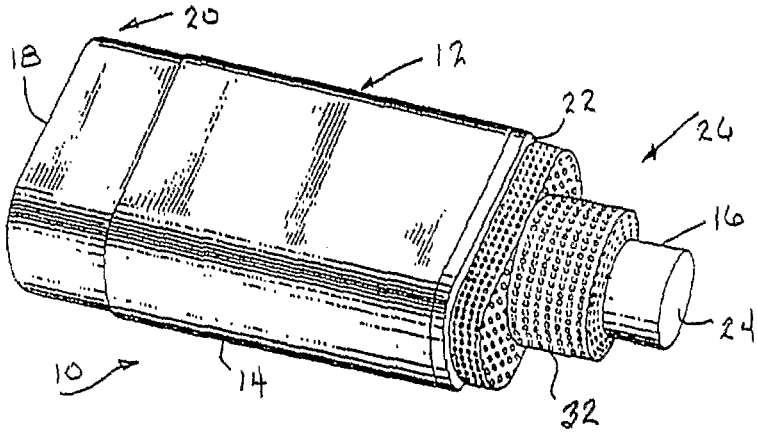
FIG. 1 is a perspective view of an exemplary sound generator module (described in PCT/US2004/011079) suitable for use in a fully implantable hearing aid system in accordance with the present invention.
Figure 2:
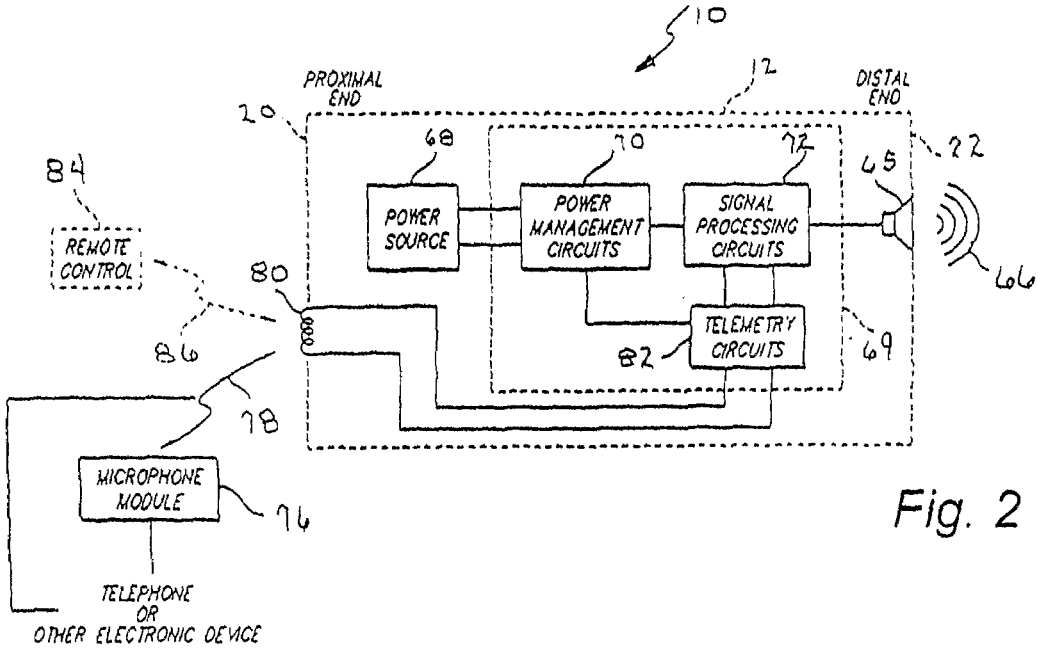
FIG. 2 is a schematic block diagram depicting an exemplary sound generator module including an electric/acoustic (E/A) transducer, e.g., speaker, driven by a sound receiver module, e.g., microphone, (as discussed in PCT/US2003/035348)
Figure 3:
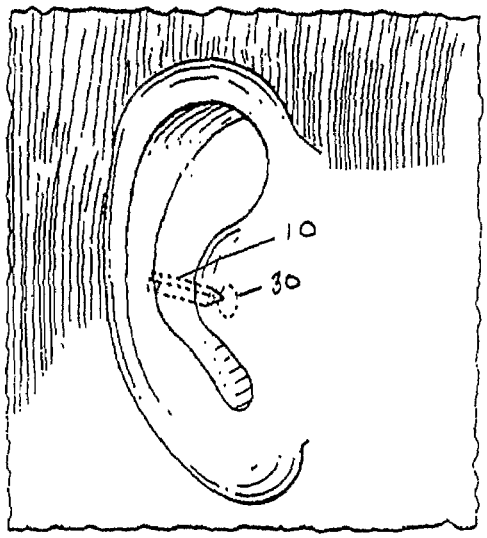
FIG. 3 is a schematic side view showing how the module of FIG. 1 can be implanted for projecting sound energy into a patient's outer ear canal (as discussed in PCT/US2004/011079)

Attention is initially directed to FIGS. 1-3 which depict subject matter described in the aforementioned PCT applications. FIG. 1 shows an exemplary sound generator module 10 comprising a housing 12 having a body portion 14 and a projecting stud portion 16. The body portion 14 defines a rear face 18 at its proximal end 20 and extends longitudinally therefrom to a laterally oriented shoulder surface 22. The stud portion 16 extends longitudinally from the shoulder surface 22 and terminates at a stud outer face or diaphragm 24 at the housing distal end 26. The sound generator module 10 is configured of materials and dimensions suitable for implantation in soft tissue proximate to a patient's outer ear canal 30, as depicted in FIG. 3. More particularly, the module 10 is intended for implantation so as to project sound energy from the stud face 24 into the patient's outer ear canal 30. Preferably, the stud 16 projects percutaneously through the skin surrounding the outer ear canal 30 to place the stud face 24 immediately adjacent to, or within, the outer ear canal.

As is depicted in FIG. 1, and as is explained in the aforementioned '011079 PCT application, a layer of porous material 32, e.g., a titanium mesh, is affixed to the outer surface of the stud 16 and/or the shoulder surface 22 to promote tissue ingrowth around the stud to form an infection resistant barrier and to anchor the housing distal end 26 in place.

FIG. 2 depicts an exemplary arrangement of electronic function blocks within the sound generator module housing 12 for driving an electric/acoustic output transducer 65, e.g., speaker, to produce sound energy 66. The speaker 65 is oriented within the module housing primarily to direct the produced sound energy out through stud face 24. The speaker 65 is driven by power source 68 and electronic circuitry 69 including power management circuitry 70 and signal processing circuitry 72. In the arrangement of FIG. 2, an external sound receiver module 76, e.g., a microphone, telephone, or other device, produces an electrical signal(s) representative of ambient sound which signal is then communicated via a wireless medium 78, e.g., an RF link, to antenna 80 and telemetry circuitry 82 and then to signal processing circuit 72 for driving speaker 65. A hand-held remote control 84 can be provided to enable the user to selectively adjust various operating parameters of the circuitry, e.g., gain, equalization, etc. via the wireless telemetry link 86 including, i.e., antenna 80 and telemetry circuit 82.

Figure 4:
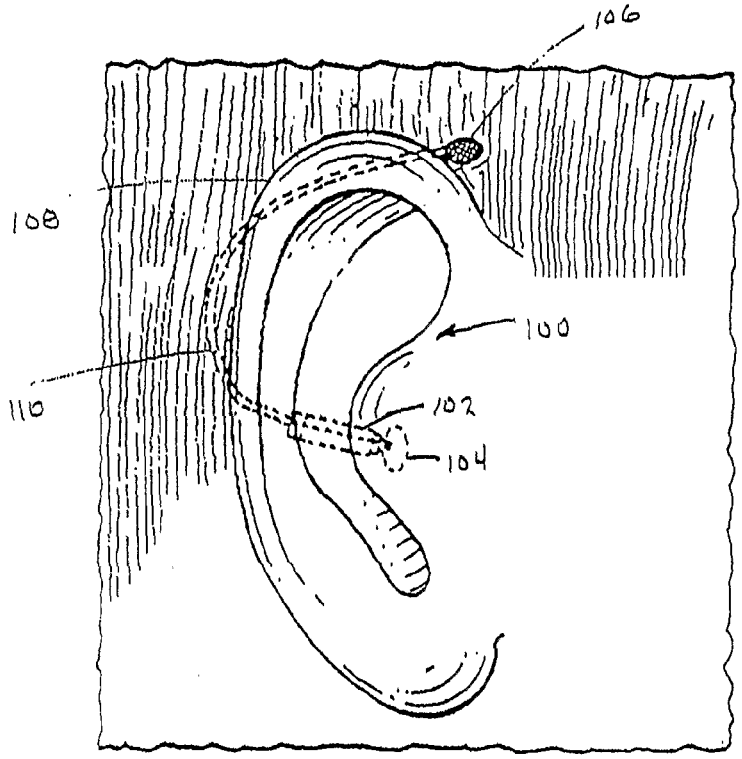
FIG. 4 is a schematic side view of a system in accordance with the present invention which includes, in addition to the implanted sound generator module shown in FIG. 3, an implanted sound receiver module and an implanted cable electrically connecting said sound generator and receiver modules.

Attention is now directed to FIG. 4 which depicts a fully implanted hearing aid system 100 in accordance with the present invention The system 100 includes:

a) a sound generator module 102 implanted proximate to a patient's outer ear canal 104;

b) a sound receiver module 106 implanted in subcutaneous tissue proximate to the patient's pinna 108; and c) an electric cable 110 implanted in subcutaneous tissue for directly connecting the sound generator module 102 and sound receiver module 106.

Figure 5:
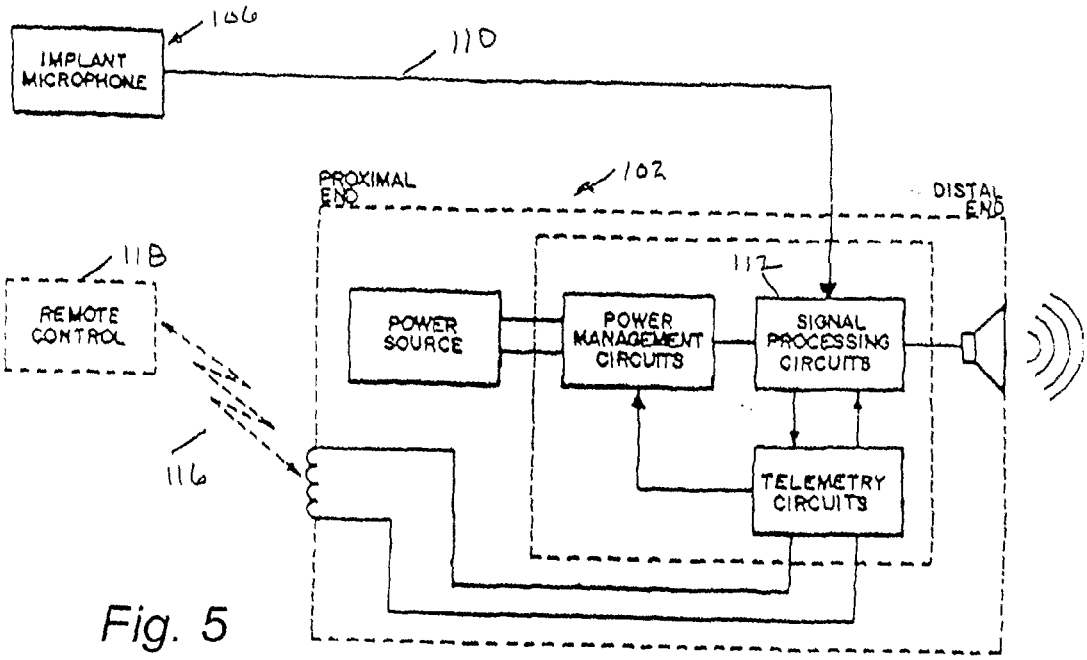
FIG. 5 is a block schematic diagram showing how FIG. 2 can be modified in accordance with the present invention for use with an implanted sound receiver module and implanted cable.

FIG. 5 shows a block diagram of the functional electronics within sound generator module 102 which, it can be noted, are substantially identical to that shown in FIG. 2. However, in accordance with the present invention, the sound receiver module 106 communicates with the signal processing circuits 112 within module 102 directly via implanted cable 110, rather than via a wireless telemetry means 78, as shown in FIG. 2. A wireless telemetry link 116 is depicted in FIG. 5 but is provided only for use by the remote control device 118 to enable the user to vary the operating parameters of the signal processing circuits 112.

Figure 6B:
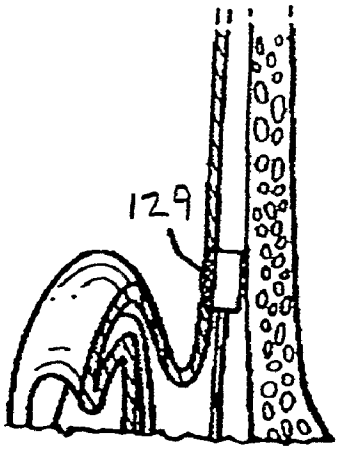
FIG. 6B is a fragmentary schematic sectional view corresponding to a portion of FIG. 6A showing how the receiver module can be alternatively implanted to extend percutaneously through the patient's skin.
Figure 6A:
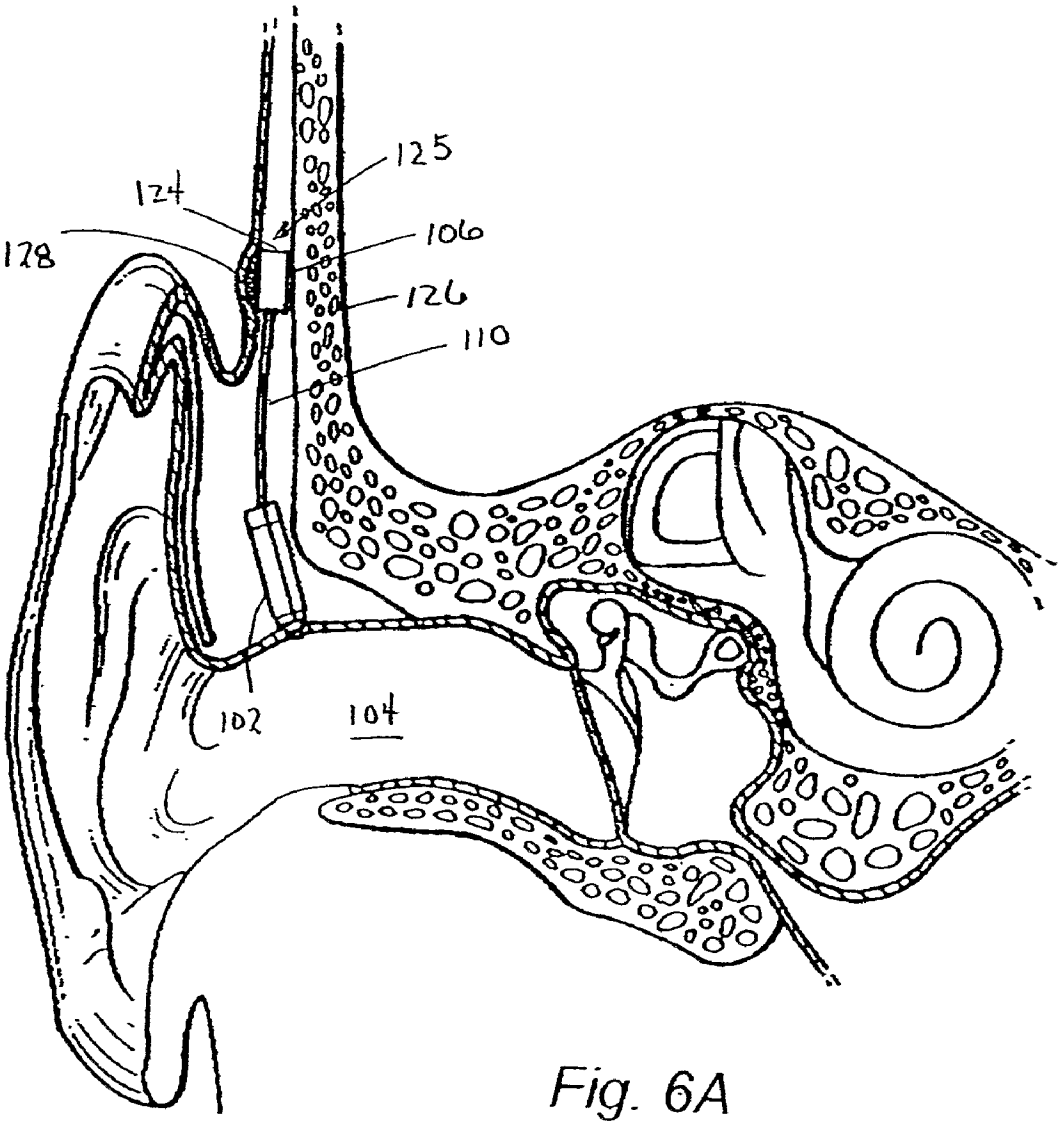
FIG. 6A is a schematic front sectional view showing particularly the sound receiver module implanted subcutaneously beneath the patient's skin and against the temporal bone.

Attention is now directed to FIG. 6A which shows the sound generator module 102 implanted proximate to the patient's outer ear canal 104. The electric cable 110 extends from the module 102 to the sound receiver module 106. The module 106 is comprised of a thin case 124 enabling it to be implanted at a site 125 between the patient's temporal bone 126 and skin 128. By configuring the case 124 within a thickness of 2 mm or less, it can be implanted against the temporal bone 126 beneath the skin 128 without requiring any deep tissue cutting or bone modification. Thus, the sound receiver module 106, as well as the sound generator module 102, can be implanted in a procedure performed in a physician's office under local anesthesia. The same procedure also allows the physician to implant the cable 110 by tunneling the cable through soft tissue between the patient's skin and bone along a path substantially as shown in FIG. 4.

In an exemplary system in accordance with the invention, one end of the cable 110 is permanently connected to the sound generator module 102 at time of manufacture. In an exemplary implantation procedure, the other, or free end of the cable, remote from the sound generator module, is surgically tunneled between the patient's skin and bone to a receiver site preferably located above the patient's pinna. The aforementioned sound receiver module 106 is implanted at the receiver site 125 and connected to the cable free end.

The sound receiver module 106 includes an acoustic/electric input transducer, e.g., a microphone having a diaphragm 129 opening through the wall of case 124. The case 124 can be implanted selectively either (1) completely under the skin 128 (subcutaneous) as shown in FIG. 6A enabling the microphone to gather acoustic energy through the skin 128 or (2) partially under the skin as shown in FIG. 6B, with the diaphragm 129 protruding through the skin 128 (percutaneous) to directly gather sound energy. The diaphragm 129 may be covered by a suitable membrane, e.g., silicone, to facilitate sound transmission and to protect the diaphragm. The cable 110 which is surgically tunneled between skin and bone from the sound generator module 102 proximal end to the receiver site 125 can be electrically connected to the receiver module 106 as part of the implantation procedure. Alternatively, the module 106 can be permanently electrically connected to the cable 110 if its dimensions are selected to be sufficiently small to allow it to be tunneled subcutaneously to the receiver site.

From the foregoing, it should now be recognized that an enhanced hearing aid system has been described which can be fully implanted in a patient in a simple procedure capable of being performed within a physician's office under local anesthesia. The procedure avoids any need for deep tissue cutting and/or bone modification. Although only a limited range of exemplary embodiments have been specifically described herein, it is recognized that various alternatives and modifications will occur to those skilled in the art which fall within the intended scope of the appended claims.

The invention claimed is:

1. A system for enhancing a patient's ability to hear audible sound, said system comprising:

a sound generator module including an output transducer responsive to an applied electric drive signal for producing sound energy;

said sound generator module comprising a housing configured for implantation in subcutaneous tissue adjacent to the patient's outer ear canal for projecting said sound energy into said outer ear canal;

a sound receiver module including an input transducer responsive to audible sound for producing an electric drive signal representative of said audible sound;

said sound receiver module comprising a case configured for implantation proximate to the patient's pinna;

an electric cable connecting said sound receiver module to said sound generator module for applying said electric drive signal to said output transducer;

wherein said electric cable is configured for subcutaneous implantation extending between said sound receiver module and said sound generator module;

wherein said sound generator module housing includes a body portion and a projecting stud portion; and wherein said stud portion is configured to project percutaneously through the patient's skin surrounding said outer ear canal for projecting sound energy into said outer ear canal.

2. The system of claim 1 wherein said stud portion defines an outer surface; and wherein a layer of porous material is mounted on said stud outer surface for promoting tissue ingrowth.

3. The system of claim 1 wherein said stud portion projects from a shoulder surface of said body portion; and wherein a layer of porous material is mounted on said shoulder surface for promoting tissue ingrowth.

4. The system of claim 1 wherein said output transducer comprises a speaker mounted in said housing and oriented to project sound energy through said stud into said patient's outer ear canal.

5. The system of claim 4 wherein said input transducer comprises a microphone mounted in said case and oriented to respond to audible sound for producing an electric drive signal.

6. The system of claim 5 further including signal processing circuitry in said housing for responding to the electric drive signal produced by said microphone for applying an electric drive signal to said speaker.

7. The system of claim 1 wherein said sound receiver module case has a thickness of 2 mm or less for enabling said case to be subcutaneously implanted between the patient's skin and temporal bone proximate to said patient's pinna.

8. The system of claim 1 wherein said sound receiver module input transducer is implanted subcutaneously.

9. The system of claim 1 wherein said sound receiver module input transducer extends percutaneously.

10. The system of claim 1, wherein said sound receiver module further includes a diaphragm portion covered by a protective sound transmissive membrane.

11. The system of claim 1, wherein said sound receiver module is permanently connected to the cable and configured to be surgically tunneled.

12. The system of claim 1, wherein said sound receiver module is configured to be connected to the cable after the cable has been surgically tunneled.

13. A method for implanting a hearing aid system for projecting sound energy into a patient's outer ear canal, said method comprising;

providing a sound generator module operable to produce sound energy in response to an applied electric drive signal, the sound generator module comprising a housing implantable outside the ear canal including a stud portion projecting through the patient's skin surrounding the ear canal and into the outer ear canal;

implanting said sound generator module in a patient's subcutaneous tissue for projecting said produced sound energy into said patient's outer ear canal, with the stud portion projecting through the patient's skin surrounding the ear canal and into the outer ear canal;

providing a sound receiver module responsive to audible sound for producing an electric drive signal;

implanting said sound receiver module proximate to said patient's pinna; and subcutaneously implanting an electric cable extending between said sound receiver module and said sound generator module.

14. The method of claim 13 wherein said step of providing a sound receiver module comprises providing a thin case having a microphone diaphragm.

15. The method of claim 14 wherein said diaphragm is subcutaneously implanted.

16. The method of claim 14 wherein said diaphragm is percutaneously implanted.

17. The method of claim 14 wherein said thin case has a thickness of 2 mm or less and is implanted against the patient's temporal bone.

18. The method of claim 14 comprising, wherein said steps of implanting the sound generator module, sound receiver module, and electric cable are done under local anesthesia.

19. The method of claim 14, wherein said step of providing a sound receiver module comprises providing a sound receiver module permanently connected to the electric cable, and said step of subcutaneously implanting the electric cable comprises surgically tunneling the electric cable with the sound receiver module.

20. The method of claim 14, wherein said step of subcutaneously implanting the electric cable comprises surgically tunneling the electric cable without the sound receiver module; the method further comprising:

connecting the sound receiver module to the cable after said step of subcutaneously implanting the electric cable.

* * * * *